US009404279B1

(12) United States Patent
Fehr

(10) Patent No.: US 9,404,279 B1
(45) Date of Patent: Aug. 2, 2016

(54) FITNESS WALKING FACILITY

(71) Applicant: Debbie E. Fehr, Glendale, AZ (US)

(72) Inventor: Debbie E. Fehr, Glendale, AZ (US)

( * ) Notice: Subject to any disclaimer, the term of this patent is extended or adjusted under 35 U.S.C. 154(b) by 0 days.

(21) Appl. No.: 14/863,291

(22) Filed: Sep. 23, 2015

(51) Int. Cl.
*B61D 17/12* (2006.01)
*B61D 39/00* (2006.01)
*E04H 3/14* (2006.01)

(52) U.S. Cl.
CPC ..... *E04H 3/14* (2013.01)

(58) Field of Classification Search
CPC ..... E04H 3/10; E04H 3/12; E04H 3/14; A63C 19/00; A63K 1/00; Y10T 137/3802
USPC ..... 52/6, 174
See application file for complete search history.

(56) References Cited

U.S. PATENT DOCUMENTS 5,240,459 A * 8/1993 Herbert ..... A63C 19/00 472/86
5,622,013 A * 4/1997 Ban ..... E04B 7/14 52/64
5,738,588 A * 4/1998 Esser ..... A63C 19/00 256/24
6,474,023 B1 * 11/2002 Takeuchi ..... E04H 3/12 472/92
6,832,452 B1 * 12/2004 Simens ..... E04H 3/14 472/92
7,150,243 B1 * 12/2006 Greene ..... A63K 1/00 119/422
8,347,556 B2 * 1/2013 Stelmaszek ..... E04H 3/12 104/53
9,114,307 B1 * 8/2015 Rittenberry ..... A63C 19/00
2005/0107172 A1 * 5/2005 Morell ..... E04H 3/14 472/92
2006/0105847 A1 * 5/2006 Stroppiana ..... A63C 19/00 472/85
2008/0268968 A1 * 10/2008 Back ..... A63H 18/02 472/85
2010/0212232 A1 * 8/2010 Jamison ..... E04H 3/14 52/9
2011/0312429 A1 * 12/2011 Kuempel ..... A63K 1/00 472/85
2014/0283460 A1 * 9/2014 Rossetti ..... E04H 3/12 52/8

* cited by examiner

*Primary Examiner* — Brian Mattei
(74) *Attorney, Agent, or Firm* — Barbara J. Luther; The Luther Law Firm

(57) ABSTRACT

An indoor facility includes an enclosed arena; an entrance for patrons to enter and exit the facility; a reception counter to receive patrons and collect money; a track inside the facility, the track having a plurality of lanes and dividing lines therebetween; a plurality of dividers along the dividing lines, the dividers comprising walls that are at least partially opaque; a plurality of lockers with adjacent seating; a plurality of customer seating areas comprising at least seating inside the entrance and in the middle of the track; a plurality of pet locations including a pet training area, a pet dog relief park, a pet party room, and a pet shop with accessories, toys and treats; and advertising and information walls.

6 Claims, 2 Drawing Sheets

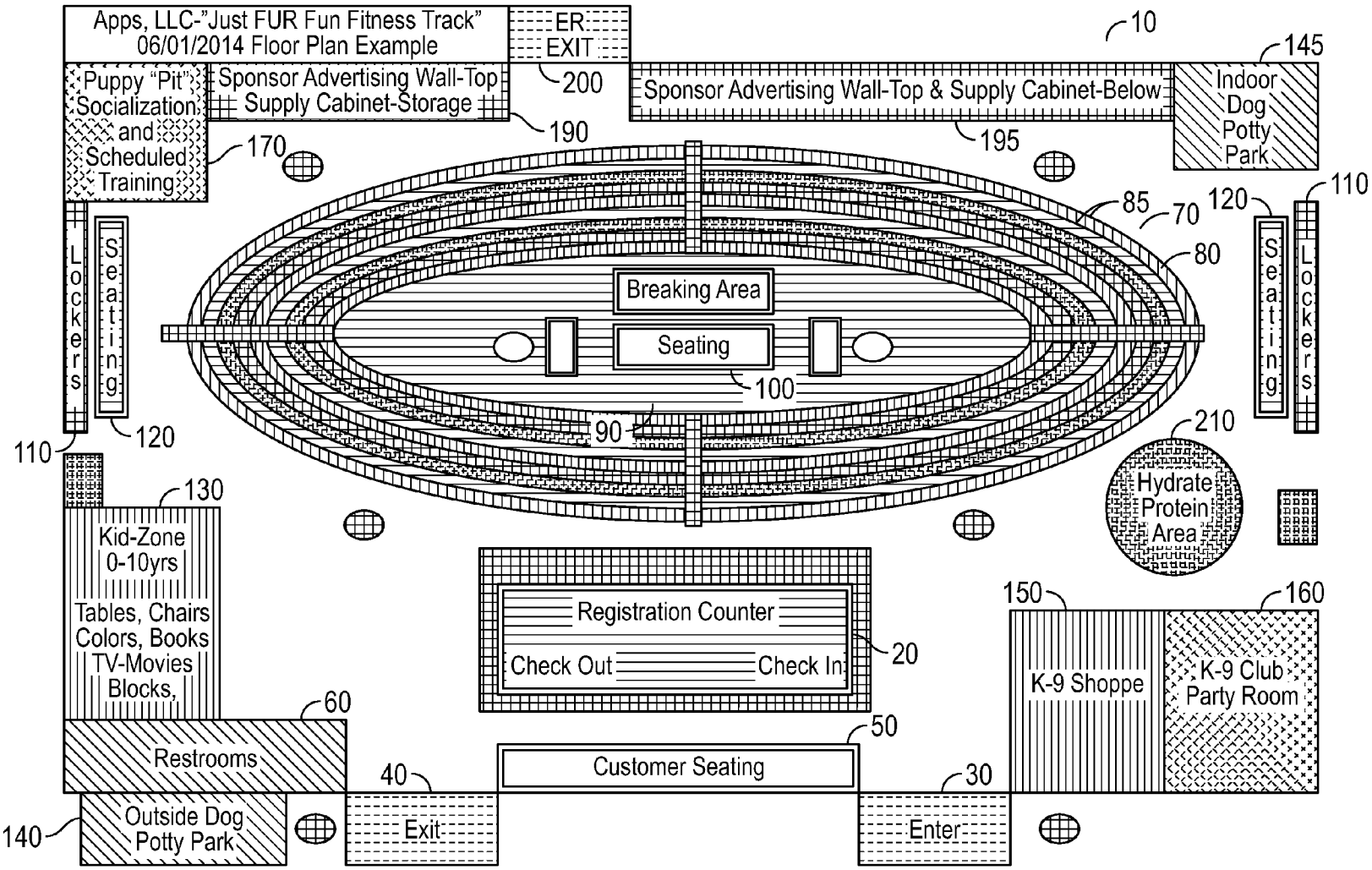
Apps, LLC-"Just FUR Fun Fitness Track"
06/01/2014 Floor Plan Example
Puppy "Pit" Socialization and Scheduled Training
Sponsor Advertising Wall-Top Supply Cabinet-Storage
ER EXIT
Sponsor Advertising Wall-Top & Supply Cabinet-Below
Indoor Dog Potty Park
Seating
Lockers
Breaking Area
Seating
Hydrate Protein Area
K-9 Shoppe
K-9 Club Party Room
Registration Counter
Check Out
Check In
Customer Seating
Enter
Exit
Kid-Zone 0-10yrs
Tables, Chairs Colors, Books TV-Movies Blocks,
Restrooms
Outside Dog Potty Park
10
20
30
40
50
60
70
80
85
90
100
110
120
130
140
145
150
160
170
190
195
200
210

(continued)
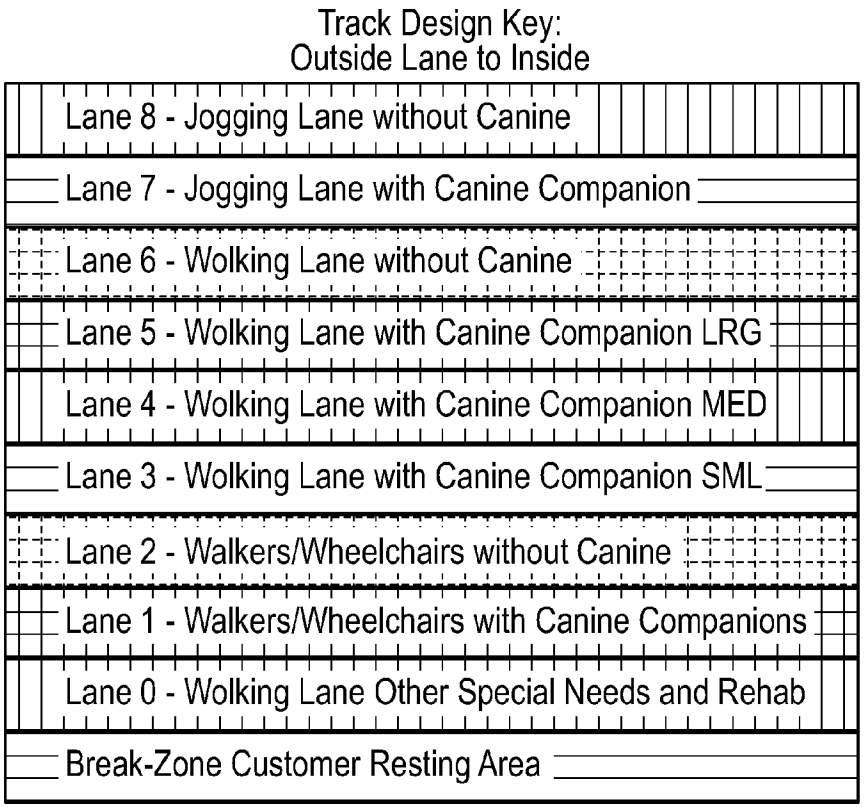
(continued)
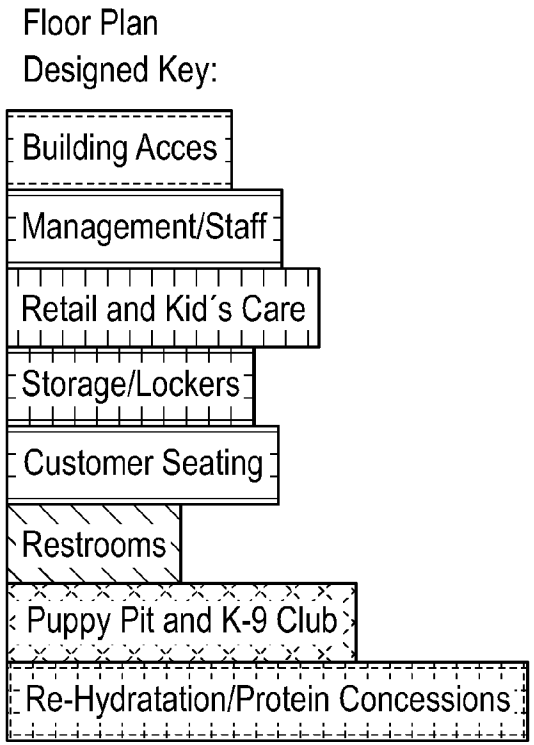

FITNESS WALKING FACILITY

TECHNICAL FIELD OF THE INVENTION

The present invention generally relates to a new gym concept. More specifically, the invention is an indoor fitness arena for humans and pets.

BACKGROUND

The fitness industry is growing with the percentage of people belonging to health clubs and gyms doubling over the past 20 years. Even more growth is expected to be powered by an aging Baby Boomer generation in search of youth and the new understanding that exercise can prevent or control many of the diseases that are driving health care costs upward.

There has been a significant increase in the number of health clubs, gyms and other fitness centers. In 2005, there were about 26, 800 which gradually increased to about 30,500 in early 2012. There appear to be about 58.5 million Americans who are utilizing fitness center via memberships.

More and more people are taking up light exercise and do not want to enter, let alone belong to a health club.

More than 6 in 10 people walk for transportation or for fun, relaxation, or exercise, or for activities such as walking the dog. The percentage of people who report walking at least once for 10 minutes or more in the previous week rose from 56% (2005) to 62% (2010).

Physical activity helps control weight, but it has other benefits. Physical activity such as walking can help improve health even without weight loss. People who are physically active live longer and have a lower risk for heart disease, stroke, type 2 diabetes, depression, and some cancers. Improving spaces and having safe places to walk can help more people become physically active.

SUMMARY OF INVENTION

In one embodiment, an indoor facility includes the following: an enclosed arena; an entrance for patrons to enter and exit the facility; a reception counter to receive patrons and collect money; a track inside the arena, the track having a plurality of lanes and dividing lines therebetween; a plurality of dividers along the dividing lines, the dividers including walls that are at least partially opaque; a plurality of lockers with adjacent seating; a plurality of customer seating areas including at least seating inside the entrance and in the middle of the track; a plurality of pet locations comprising a pet training area, a pet dog relief park, a pet party room, and a pet shop with accessories, toys and treats; and advertising and information walls.

Optionally, the advertising and information walls are shared with storage. In another alternative, the dividers are about 2-4 feet tall. The lockers and seating can be located at either end of the track. Preferably the track is about ⅛ mile long. The facility is climate controlled.

BRIEF DESCRIPTION OF THE DRAWINGS

FIG. 1 is a schematic overview of an embodiment of a fitness walking facility.

DETAILED DESCRIPTION

With an increasing number of people walking for health, I have identified a need for safer environments, with dry surfaces and comfortable temperatures. Too many locations have inclement weather a good part of the year, including excessively high or low temperatures or uncomfortable humidity. Sedentary people who want to try exercise, as well as the handicapped, may be concerned about walking in their neighborhoods and fear becoming too tired to return home. My fitness track allows people new to exercise to walk or jog as far as they want, while providing convenient benches and rehydration for when they get tired. Because the length of the track is marked, the new exerciser gets an impression of how far it is safe for him or her to walk without excessive tiredness.

Because of the extremes of weather found in many locations, I have created a climate-controlled indoor facility for walking and jogging. In our space, we have a classic oval track with multiple lanes; however, our preferred track has dividers that rise about 3 or 4 feet. Such an environment invites individuals of all ages to participate in low-impact exercise, including walkers, joggers, power walkers, and even pet walking. Dogs need not accompany people on the track, the dogs can socialize with other dogs in an adjacent pet area. Optionally pet relief areas are available inside and outside. Such a track provides security because at least one employee oversees the premises and security cameras whenever the facility is open to the public. Additionally, customers are given whistles and are asked to raise their hands if they experience a difficulty during exercise.

FIG. 1 illustrates my fitness facility 10 with all its components, some of which are optional, particularly as a facility gets started. Some facilities may take some time to add all the components, or in some cases, basic services only can be offered. We describe the basic services first.

The fitness facility 10 has front entrances and exits near a reception counter 20. When the fitness facility 10 has a separate entrance 30 and exit 40, customer seating 50 is conveniently placed between for changing footwear, etc. Restrooms 60 are also placed in that vicinity.

The track 70 is placed in the center of the fitness facility 10. The various lanes (e.g., 80) are clearly demarcated for people of different speeds to stay in their own lanes 80 and not overtake or be delayed by other walkers. Optionally each lane is separated from adjacent lanes and spaces by divided lines 85 and optional dividers (not shown). Dividers may be any height, but are preferably about 2-4 feet tall, more preferably about 3 feet tall. The height is selected to optimize two functions: 1) permit leaning and steadying by beginning walkers and 2) provide a visual barrier for dogs who might become distracted by dogs in other lanes 80. Preferably there is a handle (not shown) atop the wall to assist those rehabilitating.

The track 70 has a central breaking area 90 that accommodates central seating 100 for rest by walkers/joggers and/or less fit companions to watch the exercisers.

Different embodiments can have one or more, in any combination, of the following features. Lockers 110 will enable people to shed and secure their valuables and outer wear for more comfortable walking and jogging. A locker seating area 120 permits safer changing of footwear.

A kid zone 130 provides a fun play area for children from 0-10, providing for kid-friendly activities such as blocks, colors, books, videos, kid-friendly TV, tables and chairs. Preferably the kid zone 130 has a protective wall, limited entrance/exit for at least part of the time the fitness facility 10 is open. In some instances there may be an attendant.

Where possible, an outdoor pet relief park 140 is available for pet relief before and after exercise. Preferably the fitness facility 10 is equipped with an indoor pet relief park 145. Also for pets and pet owners, there is a pet shop 150 for all types of pet accessories from clothing to snacks (not shown). Preferably there is a party room 160 for both pets and people. This party room 160 can be equipped with seating, tables, and pet friendly accessories, such as ramps and stairs (not shown). A pet training room 170 is optionally provided for not only scheduled training with pet trainers (while the owner walks or jogs) but also for puppy socialization to other species and dog sizes. Such a room has walls, of which the lower part is opaque (to limit pet distractions) and the upper part can be opaque or transparent.

One or more outer walls or portions of walls accommodate a sponsor acknowledgement area 190 with room for supply cabinets and miscellaneous storage. Another outer wall or portion thereof accommodates an advertising area 195 with optional storage. Other features, as required by local code, customers demand or owner convenience include, but are not limited to, an emergency exit 200.

The retail area also offers human-oriented re-hydration and protein concessions 210, as well as products for pets.

With removable track walls, the indoor fitness facility can also be used for community events, such as fundraising gatherings. With the track walls in place, the facility can be used for fundraising walk-a-thons and jog-a-thons, at any time of the year, not just in the comfortable months of the year. Other community-oriented event for the fitness facility including health screenings, flu shots, canine vaccinations and county licensing. The fitness facility can also stage competitions for most miles walked in a month, as well as other activities to encourage fitness.

Besides canine obedience classes, the fitness facility can also host other pet-related activities, including but not limited to pet fitness classes by veterinarians and county licensing events to make licensing easier in the neighborhoods.

We plan to use walls (and other surfaces) to market pet and human fitness with frequently changed alerts and reminders. The fitness facility will also teach and sell people products to encourage fitness, including health/exercise monitors, etc. Other useful products include vitamins, rehydrating solutions, healthful bars, etc.

The fitness facility is situated in a large building. Initially, a skid-free surface is applied to the floor. If necessary, the HVAC is upgraded to provided a uniformly comfortable exercise environment year round. Then, the track is laid out with lanes and markings, leaving a central rest area. Along the track markings, opaque walls are built to separate dog-owner pairs from other dog-owner pairs and limit distractions from exercise. Additional walls are built to demarcate side areas, including the retail and reception areas, restrooms, pet relief area, pet party room, pet training room and storage cabinets. Video screens are installed above the storage cabinets to accommodate advertising and sponsor announcements. An optional sound system offers announcements and music to walk by, etc. Indoor and outdoor security cameras will track customers and enable employees to be quickly aware of any difficulties. The reception desk provides money collection, customer tracking, viewing of the lanes and security cameras.

The above-described facility is used to provide preventive health, rehabilitation, exercise and relaxation. Often healthcare practitioners will recommend walking, jogging and other exercises, as well as milestones or parameters to be achieved. We provide an introductory video on walking and jogging as exercise to be played in the unoccupied party room. We also provide advertising and sponsorship opportunities. Customers rehydrate at a centrally located rehydration station. Joggers without animals can use the outermost lane of the track. Handicapped individuals preferably use the inner lane(s) for quicker access to the central rest benches. Employees are encouraged to bring their own animals and let customers walk and play with the pets if so desired.

All customers enter at the entrance in front of the reception desk. There customers select the individual visit or a monthly package and pay accordingly. They are given a key to a locker to store their belongings during their exercise. When they are ready to exercise, they assess the speed of the other customers on the track and pick a lane intermediate between a slower and a faster customer. Basically, joggers take the outer lane(s) and rehab individuals take the inner lane. They may keep their dogs on a leash or leave their pets in a different area. They may use exercise fluids and/or snacks during their walk. They also have the option of sitting on one of the several benches.

EXAMPLE 1

A 20,000 sq ft or larger building has floor drains. We prepare the floor with non-skid paint coating for safety. We mark off a $1/8^{th}$ mile outer oval track with wide lanes, such as 54 inches wide. We complete the markings for each lane. There is a central rest area. Next, we install 2" wide bars along each lane marking which are 3" from the floor. We attach lane walls approximately 48" tall over the bars. We then add a wall cap or handle to complete the walking lanes for use. The walls can be vinyl laminate for easy cleaning. We add appropriate entrance(s) and exit(s), restrooms and a reception area that is preferably raised for better employee viewing of the track.

Around the track we add triangular, square and/or rectangular areas for retail sales, puppy training, concessions which are friendly to dogs and customers.

As can be seen from the drawing figure and from the description, each embodiment of the fitness facility in accordance with the present invention solves a problem by addressing an advertiser's need to direct a consumer's attention to an advertising message contained on outer walls.

Although specific embodiments have been illustrated and described herein, those of ordinary skill in the art will appreciate that any arrangement calculated to achieve same purposes can be substituted for the specific embodiments shown. This disclosure is intended to cover any and all adaptations or variations of various embodiments of the invention. It is to be understood that the above description has been made in an illustrative fashion, and not a restrictive one.

Combinations of the above embodiments, and other embodiments not specifically described herein will be apparent to those of skill in the art upon reviewing the above description. The scope of various embodiments of the invention includes any other applications in which the above structures and methods are used. Therefore, the scope of various embodiments of the invention should be determined with reference to the appended claims, along with the full range of equivalents to which such claims are entitled.

In the foregoing description, if various features are grouped together in a single embodiment for the purpose of streamlining the disclosure, this method of disclosure is not to be interpreted as reflecting an intention that the claimed embodiments of the invention require more: features than are expressly recited in each claim. Rather, as the following claims reflect, inventive subject matter lies in less than all features of a single disclosed embodiment. Thus the following claims, and such other claims as may later be added, are hereby incorporated into the description of the embodiments of the invention, with each claim standing on its own as a separate preferred embodiment.

What is claimed is:

1. An indoor facility comprising a. an enclosed arena;

b. an entrance for patrons to enter and exit the facility;

c. a reception counter to receive patrons and collect money;

d. a track inside the facility, the track having a plurality of lanes and dividing lines therebetween;

e. a plurality of dividers along the dividing lines, the dividers comprising walls that are at least partially opaque;

f. a plurality of lockers with adjacent seating;

g. a plurality of customer seating areas comprising at least seating inside the entrance and in the middle of the track;

h. a plurality of pet locations comprising a pet training area, a pet dog relief park, a pet party room, and a pet shop with accessories, toys and treats; and i. advertising and information walls.

2. The indoor facility of claim 1, wherein the advertising and information walls are shared with storage.

3. The indoor facility of claim 1, wherein the dividers are about 2-4 feet tall.

4. The indoor facility of claim 1, wherein the lockers and seating are located at either end of the track.

5. The indoor facility of claim 1, wherein the track is about ⅛ mile long.

6. The indoor facility of claim 1, wherein the enclosed arena is climate controlled.

* * * * *